United States Patent [19]

Forbes, Jr.

[11] Patent Number: 4,694,987

[45] Date of Patent: Sep. 22, 1987

[54] TWO COMPARTMENT CARRYOUT CARTON

[75] Inventor: Hampton E. Forbes, Jr., Newark, Del.

[73] Assignee: Westvaco Corporation, New York, N.Y.

[21] Appl. No.: 932,307

[22] Filed: Nov. 19, 1986

[51] Int. Cl.[4] ..... B65D 5/48

[52] U.S. Cl. ..... 229/114; 229/143; 229/902; 229/127; 229/120.04; 229/120.08

[58] Field of Search ..... 229/15, 27, 112–114, 229/127, 143, 146, 149, 902, 904, 44 R, 2.5 EC; 217/26.5

[56] References Cited

U.S. PATENT DOCUMENTS 3,580,480 5/1971 French ..... 229/2.5 EC
3,618,758 11/1971 Shaw ..... 229/44 R
3,933,296 1/1976 Ruskin et al. ..... 229/15
4,266,713 5/1981 Maroszek ..... 229/112
4,431,128 2/1984 Dirico ..... 229/15

*Primary Examiner*—Stephen Marcus
*Assistant Examiner*—Gary E. Elkins

[57] ABSTRACT

A carryout carton for food products comprises a single tray element with a pair of integral lid members. A first locking means is provided for securing one lid member to the bottom wall of the tray and a second locking means is provided for securing the second lid to the first lid. The first locking means comprises a first locking tab formed by a flap element attached to an extension of the front wall of the first lid and a first locking slot formed in the bottom wall of the tray. The second locking means comprises a second locking tab formed by an extension of the front wall of the second lid and a second locking slot formed in the front wall of the first lid member.

5 Claims, 6 Drawing Figures

Fig 4.
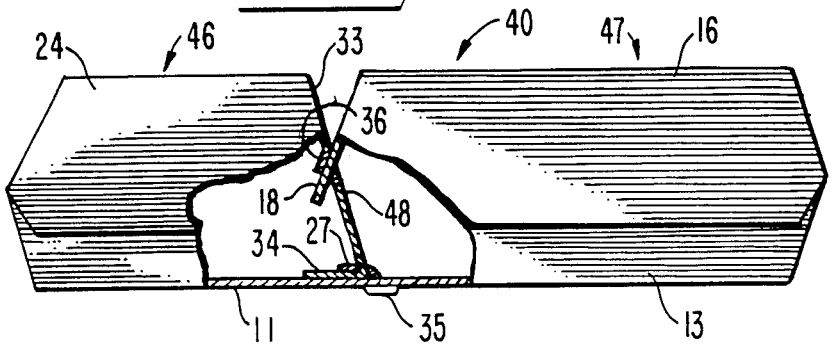
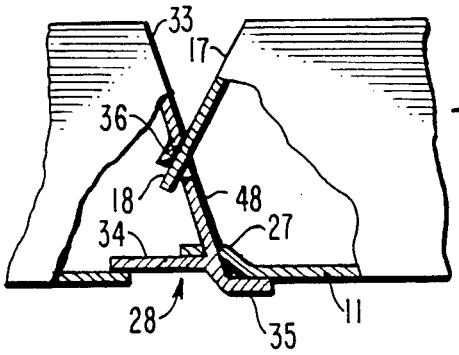
Fig 5.
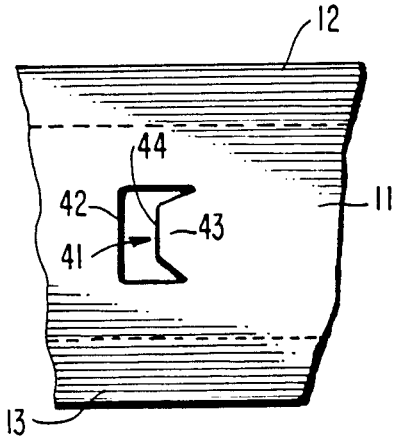
Fig 6.

TWO COMPARTMENT CARRYOUT CARTON

BACKGROUND OF INVENTION

The present invention relates to a disposable carton for carryout food products and more particularly to such a carton for packaging two different products in a single tray with two separate, integral lids.

The manufacture of disposable food cartons particularly for the fast food industry involves highly developed technology and is a competition intensive business. Since the food products sold through most fast food chains is fairly uniform, each chain strives for a unique packaging concept to achieve a competitive edge. Such cartons must be designed for maximum economy and utility with emphasis on ease of handling, filling and closing. In addition, product identification and differentiation, storage of inventory and the integrity of the carton after being filled are also important considerations. When such cartons are used to package two different food products, special consideration must be given to separating the two products while providing easy access to each product. Moreover, since such cartons are used primarily by unskilled labor, simplicity in handling procedures is important, i.e., locking means must be foolproof, readily engageable and positive.

SUMMARY OF INVENTION

Specifically, the carton of the present invention comprises a single tray element with a pair of integral lid members which cover different portions of the tray. The tray preferably has trapezoidal shaped upstanding side walls and end walls, which are connected together by corner flaps. Meanwhile, the lid members each include trapezoidal shaped, downwardly extended side walls, rear walls and front walls. The rear walls of the lid members are integrally connected to the tray end walls along fold lines and the side walls of each lid preferably extend below the upper edges of the tray side walls when the lids are closed. The lids are locked in their closed condition by locking means provided on each front wall.

The front wall of the first lid member extends below the uppe edge of the tray and includes a flap element foldably attached to the end thereof. The flap element has a trailing edge defined by its foldable connnection to the extended front wall and an opposite free edge. The flap element is preferably folded about its trailing edge inwardly of the first lid member so that its free edge lies inside the portion of the tray covered by the first lid member. In its folded condition, and with the lid closed, the flap element lies in a plane parallel and adjacent to the bottom wall of the tray. Meanwhile, the trailing edge of the flap element is provided with a first locking tab integral with the flap element that is cut from the extended front wall material so that it too lies in a plane parallel and adjacent to the bottom wall of the tray when the lid is closed. The shape of the first locking tab is not significant to the present invention, but in general, the preferred shape is of a semi-circle or semi-ellipse defined by a cut line located substantially centrally from side-to-side in the extended front wall material, the ends of which terminate at the fold line between the flap element and the front wall extension. With the lid folded down, the locking tab extends away from the lid member toward the center of the tray.

A first locking slot is provided for the first locking tab in the bottom wall of the tray comprising a generally rectangularly shaped cut out. The cut out includes a first open area into which the locking tab may be inserted and a second partially obstructed area beneath which the locking tab becomes latched. In the preferred embodiment the cut out is formed by a cut line having a central segment and a pair of terminal segments projecting generally perpendicularly from said central segment toward the partially obstructed area of the locking slot. The latter section of the locking slot is obstructed by a tongue member having a free edge which extends into the open part of the cut out area. The tongue member is formed by a portion of the tray bottom wall and is defined by extensions of the terminal segments of the cut line which forms the cut out. The tongue member preferably has a leading edge of reduced width to allow some leeway in the location of the locking slot in the tray bottom wall vis-a-vis the locking tab on the first lid front wall, and to insure for the unimpeded latching of the two members. The width of the slot is compatible with the width of the locking tab formed on the front wall of the first lid. The locking sequence between the front wall of the first lid and the tray bottom proceeds as follows. Initially the tray and lids are formed and left completely open so they can be readily nested and stacked for use. When it is desired to close the first lid, the flap element attached to the front wall extension of the first lid is folded toward the center of the tray to expose the first locking tab. The lid is then folded downwardly over its tray portion and the flap element engages the bottom of the tray wall. At this point, the location of the locking tab and the locking slot are preferably substantially superimposed with the locking tab projecting over the obstructed area of the locking slot. To engage the locking members the front wall is urged back to enable the free end of the tab to clear the leading end of the tongue member and then released permitting the locking tab to slide beneath the tongue member of the locking slot and thus latch the lid to the tray. This lock has been defined as a double base lock produced by a single motion to yield an inside/outside lock, i.e., tab outside, tongue member inside. Reversing the steps outlined above allows the user to release the lid if desired.

Meanwhile the second lid element is attached to the first lid element to completely close the carton as follows. The leading edge of the front wall of the second lid element is provided with a second locking tab of any convenient shape. The preferred shape is semi-circular or semi-elliptical and the locking tab is preferably located substantially centrally of said fron wall from side-to-side. The locking slot for the second locking tab is preferably provided in the front wall of the first lid element above the first front wall extension. The slot may be formed by a simple U-shaped cut line having a central segment and a pair of end segments located generally perpendicular to said central segment. The ends of the U-shaped cut may project upwardly or downwardly with respect to the front wall extension, but are preferably directed upwardly or away from the front wall extension. Since the lock between the secodn lid and first lid for the second lid element is preferably a temporary locking feature, the locking elements are releasibly engaged, and not as securely latched as the lock between the first lid element and the tray bottom wall. The location of the U-shaped cut in the front wall of the lid is designed to be compatible with the location of the locking tab on the front wall of the second lid element, i.e., substantially centrally thereof from side-to-side. The elevation of the locking slot on the front wall is such that the locking tab on the second lid element enters the slot and becomes fully engaged therein at about the same time that the overhanging extended side walls of the second lid element engage the top edge of the tray side walls.

Accordingly it is a general object of the present invention to provide a food carton comprising a single tray with paired lids covering different portions of the tray which lids are locked respectively to the tray bottom wall and between one another to provide a two compartment carton.

A more specific object of the present invention is to provide in such a carton a readily engageable, secure locking means between the first lid and the tray bottom wall and a readily engageable yet releasible locking means between the second lid and the first lid.

The foregoing explanation is indicative in a general way of the nature and scope of the present invention. Other and more specific advantgages will become apparent to those skilled in the art upon a full understanding of the construction and operation of the improved locking means for the carton disclosed more fully hereinafter.

DESCRIPTION OF DRAWINGS

FIG. 4 is a side elevational view of the closed carton with a portion of the side wall broken away to show the relationship of the locking elements;

FIG. 5 is an enlarged, partial sectional view of FIG. 4 showing details of the locking means; and FIG. 6 is a partial plan view of a modified blank structure showing a variation in the locking slot for the tray bottom wall.

DETAILED DESCRIPTION

Figures 1, 2, 3:
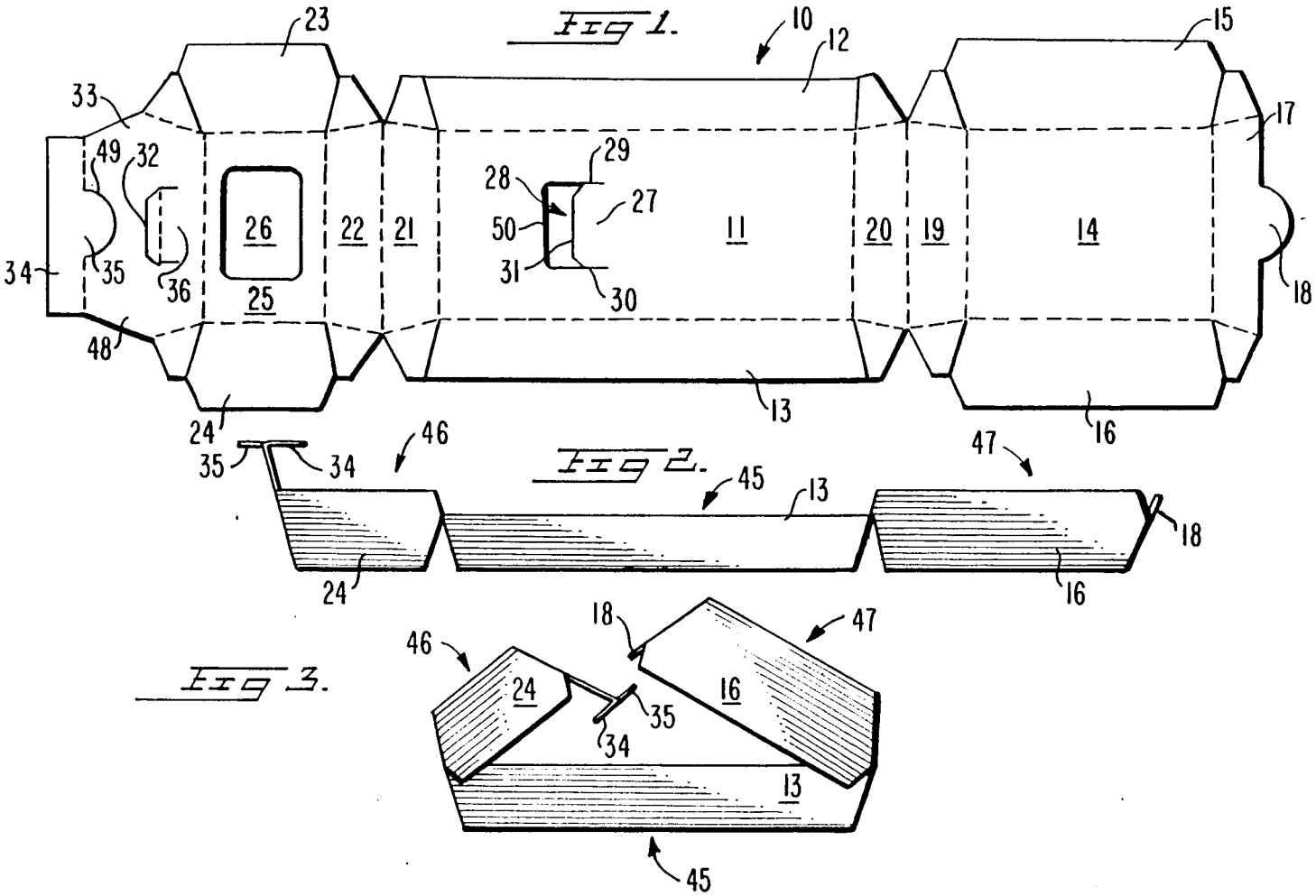
FIG. 1 is a plan view of a cut and scored blank of paperboard or the like useful for forming the carton according to one embodiment of the present invention.
FIG. 2 is a side elevational view of the carton formed from the blank of FIG. 1.
FIG. 3 is a side elevational view of the carton with the two lid elements partially closed.

In one embodiment of the present invention, the carton is prepared from a single paperboard blank 10 as shown in FIG. 1. Blank 10 is adapted to form a tray element 45 with integral lids 46 and 47. The tray component comprises a central bottom wall 11 with opposed side walls 12,13 and opposed end walls 20,21 foldably connected thereto. Each of the side and end wall panels are in the general shape of a trapezoid with the minor base portion of each connected to the bottom wall 11.

In like fashion, the first lid member 46 includes a central top panel 25 with opposed side walls 23,24 and opposed end walls 22,23 foldably connected thereto. The end wall 22 of lid 46 is foldably connected to end wall 21 of tray 45 and the top panel may include an opening 26 for specialized products. Meanwhile, end wall 33 (designated a front wall) includes an extended portion 48 and has foldably attached to an end thereof a flap element 34. The flap element 34 includes an integral tab member 35, which is formed from material cut from the front wall extension 48, defined by an arcuate cut line 49 located along the foldable connection to front wall extension 48. The shape of the tab 35 is not significant but it should at least have somewhat tapered or curved sides and an leading edge smaller than its base. Front wall 33 also includes a locking slit formed in its upper portion by a cut line 32. The cut line 32 preferably is generally U-shaped to define a tongue member 36 that may include a transverse score to make it readily bendable.

At the opposite end of tray 45 and second lid element 47 includes a top panel 14, side walls 15,16 and end walls 17,19. End wall 17 is designated as a front wall and it includes an integral locking tab 18 along its free edge which is preferably semi-circular or semi-elliptical in shape. The shape of tab 18 is not particularly significant but it too should have the same general configuration described for tab 35.

As shown in FIGS. 2 and 3, the carton comprises a single tray 45 and a pair of lids 46,47 which together cover the entire tray area. The two lids engage one another when the carton is closed. The lid 46 includes a locking means defined by flap 34 and tab 35 and is latched in a positive manner to the tray bottom wall 11, and lid 47 includes a locking means defined by tab 18 which is releasibly latched to lid 46. The latching means for tab 35 of lid 46 is provided in the bottom wall 11 of tray 45 as shown in FIG. 1. For this purpose, a slot 28 is cut in bottom wall 11 by cut lines 50, 29 and 30. The cut lines 29,30 include extensions which define a tongue member 27 with a free edge 31 that partially obscures the slot 28. The slot 28 is of a size sufficient to permit the tab 35 to be inserted beneath the leading edge 31 of tongue 27 where it is captured and retained in place. This manipulation produces an inside/outside lock that is quite secure and reliable.

FIGS. 4 and 5 illustrate in detail the latching arrangement between tab 35 and tongue 27 and the releasible lock between tab 18 and tongue 36. In the carton 40 shown in FIG. 4, the flap element 34 on front wall extension 48 rests on the bottom wall of the tray and serves as a guide for tab 35 which is first inserted through slot 28 and guided beneath tongue 27 to provide an inside/outside lock between the lid 46 and tray 45 (see FIG. 5). Meanwhile, tab 18 of lid 47 is simply inserted in the slot formed by slit 32 in front wall 33 to bend the tongue element 36 and releasibly retain the two lids together.

FIG. 6 illustrates a modified shape for the slot 41 in bottom wall 11. The modified shape yields a tongue element 43 with a more severely tapered leading edge 44 which functions in the same manner as the slot 28 and tongue 27 shown in FIG. 1.

Each embodiment of the invention disclosed herein illustrates a positive latching means between the tray and one lid of the carton which is effected substantially automatically because of the relationship of the parts. A releasible friction lock is provided between the second lid and the first lid to completely close the carton. When closed the carton effectively has two compartments covered by the two lids for packaging dissimilar products. Accordingly while only two embodiments have been shown in detail, the invention and its limitations are appropriately defined by the scope of the appended claims.

What is claimed is:

1. In a carton comprising a single tray and a pair of lid members, said tray having a bottom wall and trapezoidal shaped upstanding side walls with upper edges and said lid members having trapezoidal shaped, downwardly extending side walls, rear walls and front walls, one of said front walls being extended below the upper edges of the tray side walls into the tray to form a front wall ceiling, means for foldably attaching the rear walls of said lid members to opposed side walls of the tray, a flap element foldably connected along a fold line to the front wall extension of one of the lid members, and flap element having a free leading edge and a trailing edge defined by its foldable connection to the front wall extension, means for releasably connecting the front wall of one lid member to the front wall of the other lid member, and a locking means between the bottom wall of the tray and the flap element attached to said front wall extension, said locking means including a male locking tab integral with the flap element cut from the extended front wall material, and a female locking slot of substantially rectangular shape cut from the tray bottom wall material.

2. The carton of claim 1 wherein the male locking tab extends from the trailing edge of the flap attached to said extended front wall and is defined by a cut line substantially centrally located from side-to-side, the ends of which terminate at the fold line between said flap element and front wall extension, said tab and flap element in one position lying in a plane parallel and adjacent to the tray bottom wall and in another position with said tab inserted in the female locking slot.

3. The carton of claim 2 wherein the cut line is arcuate in shape and is curved convexly into the front wall extension with respect to the fold line between the flap and front wall extension.

4. The carton of claim 3 wherein the female locking slot is defined by a cut out located substantially centrally in the tray bottom wall having a portion of at least one inner edge projecting into the cut out area to define a tongue member.

5. The carton of claim 4 wherein the tongue member is defined by extensions of cut out cut lines which extend behind the inwardly projecting edge at two adjacent sides of the cut out.

* * * * *